US010729195B2

(12) United States Patent
Truelove, III et al.

(10) Patent No.: US 10,729,195 B2
(45) Date of Patent: Aug. 4, 2020

(54) SHOULDER TRANSFER WEIGHT SUPPORT

(71) Applicants: Leroy Truelove, III, Wilmimgton, NC (US); William Buchanan, Wrightsville Beach, NC (US); Richard S. Moore, Jr., Wilmington, NC (US)

(72) Inventors: Leroy Truelove, III, Wilmimgton, NC (US); William Buchanan, Wrightsville Beach, NC (US); Richard S. Moore, Jr., Wilmington, NC (US)

(73) Assignee: NITMOI, LLC, Wilmington, NC (US)

( * ) Notice: Subject to any disclaimer, the term of this patent is extended or adjusted under 35 U.S.C. 154(b) by 230 days.

(21) Appl. No.: 15/896,235

(22) Filed: Feb. 14, 2018

(65) Prior Publication Data

US 2018/0228235 A1 Aug. 16, 2018

Related U.S. Application Data

(60) Provisional application No. 62/458,623, filed on Feb. 14, 2017.

(51) Int. Cl.

| | |
|---|---|
| ***A41F 19/00*** | (2006.01) |
| ***G21F 3/02*** | (2006.01) |
| *A41D 13/015* | (2006.01) |

(52) U.S. Cl.

CPC ..... *A41F 19/00* (2013.01); *G21F 3/02* (2013.01); *A41D 13/015* (2013.01)

(58) Field of Classification Search

CPC ..... A41F 19/00; G21F 3/02; A41D 13/015; A45F 3/08; A45F 3/10; A45F 3/04; A45F 2003/146

See application file for complete search history.

(56) References Cited

U.S. PATENT DOCUMENTS

| | | | | |
|---|---|---|---|---|
| 4,015,759 | A * | 4/1977 | Dreissigacker | A45F 3/10 224/262 |
| 4,214,685 | A * | 7/1980 | Pletz | A45F 3/04 224/634 |
| 5,609,278 | A * | 3/1997 | Fresco | A45C 5/14 224/153 |
| 5,834,789 | A | 11/1998 | Marchione | |
| 5,844,246 | A | 12/1998 | Marchione | |
| 8,182,439 | B2 * | 5/2012 | Glenn | F41H 1/02 224/637 |
| 8,710,477 | B1 | 4/2014 | Marchione | |
| 9,504,307 | B1 * | 11/2016 | Burnett | A45F 3/10 |
| 9,629,443 | B2 * | 4/2017 | Searle | A45F 3/08 |
| 2002/0153401 | A1 | 10/2002 | Werling | |
| 2005/0040193 | A1 * | 2/2005 | May | G10D 13/00 224/201 |
| 2013/0270462 | A1 | 10/2013 | Beck | |

* cited by examiner

*Primary Examiner* — Corey N Skurdal

(74) *Attorney, Agent, or Firm* — Russell D. Nugent; The Humphries Law Firm, P.C.

(57) ABSTRACT

A wearable weight support that transfers the weight of heavy garments that rely on shoulder support, off of the shoulders to the hips of the user. The device provides additional posterior radiation protection to the wearer as the back support can be made from radio-opaque materials. The device also provides lumbar support and results in less body heat containment through natural venting. The device is easily adjustable to any body type and allows the wearer to move more freely in their work environment. The invention can be used to transfer the weight of a backpack or other systems which rely on shoulder support to function.

17 Claims, 6 Drawing Sheets

SHOULDER TRANSFER WEIGHT SUPPORT

CROSS-REFERENCE TO RELATED APPLICATIONS

This Application claims the benefit of priority to U.S. Provisional Application No. 62/458,623 filed on Feb. 14, 2017. The content of U.S. Provisional Application No. 62/458,623 filed on Feb. 14, 2017 is incorporated by reference in its entirety.

BACKGROUND OF THE INVENTION

(a) Field of the Invention

The present invention is in the technical field of medical devices. More particularly, the present invention is in the technical field of support devices to be worn by medical professionals conducting procedures involving exposure to radiation.

(b) Background Art

There are several occupations which require personnel to wear heavy clothing and/or to attach heavy items to their clothing, including heavy shielding garments. For example, in the medical field, personnel are required by law to protect themselves from excessive radiation exposure in order to reduce their lifetime risk for life threatening illnesses. In military and law enforcement, personnel also wear heavy shielding ballistic vests to reduce their chance of a life-threatening injury. Because shielding garments are heavy, long term use can result in orthopedic injury or disability. The excessive weight on the user's shoulders results in more stress on the cervical and lumbar spines. Cervical and lumbar spine disease often occurs from long term use of such devices resulting in long term disability.

Present weight reduction systems for heavy shielding garments do not specifically relieve the weight on the wearer's shoulders. To the extent they attempt to do so, they generally redistribute only a portion of the weight to body parts other than the shoulders. For example, United States Patent Application Publication Number US 2002/0153401 describes a device specifically designed to transfer weight worn about the shoulder to the user's waist. However, the device physically attaches to the user's shoulder guaranteeing that the shoulder supports at least some of the weight to be distributed.

Because of the concerns about the potential health hazards to the wearers of heavy shielding garments, devices for medical personnel have been designed that suspend the weight of heavy shielding garments from the ceiling or a floor based support system. For example, the device described in United States Patent Publication Number 2013/0270462 describes a device that is so large and bulky it is attached to a moveable frame that is meant to be rolled along the floor. The disadvantages of these devices include less mobility in the work environment, limited number of individuals that can use the device in close proximity to each other, and the current costs of these devices.

Robert Marchione has described a device meant to solve some of these problems. His device is discussed in U.S. Pat. Nos. 5,834,789; 5,844,246; and 8,710,477. Those references discuss a device that has a frame including shoulder supports meant to support the weight of a garment off of the user's shoulders. However, the Marchione device is integrated into the garment and thus, can only be used with the one garment.

In addition, because the Marchione device was originally designed to be integrated into the garment, it does not provide as much space between the user and the garment, thus decreasing the ventilation experienced by the wearer. Marchione's device is so susceptible to this problem that he devised a mechanical cooling system to be used with his device. Moreover, the Marchione device does not have a back support, instead the device has shoulder extensions that extend from the hip belt and over the wearer's shoulders. This arrangement provides less ergonomic support to the user and does little if anything to prevent injury to the user's back or spine. Moreover, the lack of a back support and other structures means the device cannot be adjusted except by wearing it above the user's waist—the height of the shoulder extensions is fixed with respect to the hip belt. Further, the Marchione device does not contain means to be folded to facilitate transport or storage.

This application discloses embodiments of a wearable device which transfers weight off of the shoulders of the user by transferring the weight to the waist and hips. The invention will also result in improved posture while wearing the device by providing lumbar support. It will also provides a platform for a leaded facial splash shield, as well as reduced radiation exposure to the back of the wearer.

BRIEF SUMMARY OF THE INVENTION

The present invention is a fixed-angle, wearable device that supports the weight of a heavy garment, such as a lead apron or other heavy garment and transfers the weight of the garment that would normally be supported by the wearer's shoulders to the wearer's hips. The device eliminates contact and stress on the wearer's shoulders cervical spine. The device allows a wearer to wear a heavy garment, such as a lead apron or shield, while protecting their shoulders and spine from having to support excess weight. By transferring the weight off of the shoulders, there is also less pressure on the cervical spine as many radiologic procedures require the wearer bend forward for significant periods of time. At the same time, the device also helps to correct the wearer's posture and to support their lower back to alleviate weight and pressure that over time can cause lower back injuries. The anatomic contour of the device provides lumbar support and promotes optimal ergonomic posture. Surgeons in particular will benefit from the use of this device as it allows them to wear heavy garments during lengthy surgical procedures without straining or risking injury to their spines. The device also creates space between the wearer's body, particularly their shoulders and the backs, and as a result, helps to provide ventilation to the wearer while they are wearing a heavy garment. The weight and heat encountered by surgeons and other medical professionals that have to wear radio-opaque garments severely limits their comfort while working.

The present invention includes a light-weight, secure, and adjustable frame extending from a waist support to be worn over the shoulders. Preferred embodiments of the shoulder transfer weight support have at least three components consisting of a padded waist belt, a back support, and one or more shoulder extensions. The shoulder extensions consist of rigid bars that attach to the back support and extend away from that back support and are located in such a way as to be configured to be above the wearer's shoulders when the device is worn. Other preferred embodiments of the invention include protrusions or pins located on a surface of the shoulder supports such that the pins protrude away from the shoulder extensions and the wearer. These protrusions can be used to attach other devices, such as a splash shield or face shield to the invention. In preferred embodiments and the inventors' anticipated best mode, the pins are constructed from 6061 aluminum round stock and cut to a length of ⅜ inches with a diameter of 5/16 inches. The pins are attached to the over the shoulder aluminum bars using stainless steel flat head #6-32 machine screws and secured by #6-32 stainless steel nylon lock nuts.

In addition, preferred embodiments feature a back support formed with partial hip extensions on both sides which are of the same material as the back support. The hip extensions are form fitting and extend around the waist along the iliac crests of the wearer. The hip extensions allow for the attachment of the padded hip belt which has built-in supports.

The back support can be as simple as a form fitted plastic back plate or can involve more than one plates and/or a hinge and attachment bars. In preferred embodiments of the invention, the back support is made of an upper back plate, a lower back plate, two attachment bars and a hinge connecting the two attachment bars. The attachment bars, shoulder extensions, attachment bars and each of the plates feature drilled holes that in preferred embodiments pass completely through the structure in which they are drilled, but are not required to do so. In preferred embodiments, these drilled holes are located on the upper back plate and on the shoulder extensions such that the drilled holes can be aligned. The shoulder extensions can be attached to the back plate using traditional attachment means inserted through the drilled holes, including, but not limited to nuts and bolts, screws, pins, nails and adhesives. Alternately, the device can be constructed such that the shoulder extensions are joined permanently with the back plate to form one unitary structure. However, the preferred embodiments and the anticipated best mode of the invention uses stainless steel binding barrels to attach the shoulder extensions to the back plate.

Similarly, the same or different attachment means can be used to attach the upper back plate to one of the attachment bars, the attachment bars to each other or to a hinge, and the lower back plate to the attachment bars and the hip belt. Stainless steel binding barrels are the preferred attachment means because they have a rounded head and as a result, have less potential to catch on a lead apron or other clothing. As a result, in the preferred embodiments and anticipated best mode of the device, the drilled holes in the shoulder extensions are lined up with those on the upper back plate so the two structures can be attached as described above. In addition, the upper back plate is also attached through the same or similar means to an attachment bar. That upper attachment bar has drilled holes that can line up with holes on the upper back plate and a hinge (or the leaf or a hinge) located in between the upper back plate and the lower back plate. Similarly, the opposing end of the hinge (or the lower leaf of the hinge) can be connected through the same kinds of drilled holes to the lower or second attachment bar. The second or lower attachment bar can then be attached in the same manner to the lower back plate that is also attached in the same manner to the hip belt.

In addition, the upper back plate can feature a second set of drilled holes positioned such that when the shoulder extension(s) are attached to the upper back plate they can be moved laterally with respect to the wearer's shoulders if desired. Laterally here means the shoulder supports can be positioned closer or father away from the wearer's head. The drilled holes on the shoulder supports and upper back plate also make it possible to reposition the shoulder extensions at different heights above the user's shoulders. It is anticipated that the shoulder extensions will be attached and positioned such that the shoulder extensions stay about ¾ of an inch above the user's shoulders. However, as discussed, the height of the shoulder extensions can be modified as the wearer deems useful.

Preferred embodiments of the invention feature a hinge that allows the upper half of the device to fold down over the lower half of the device to make the device easier to carry or store. The device folds ventrally, which is to say that the upper portion of the device folds downward toward where the user's waist would be until it contacts the lower portion of the device. The hinge can be any standard hinge known in the prior art, but preferred embodiments of the invention include a slip-hinge with a bore and a pin that inserts into the bore to lock the hinge in position. More specifically, the hinge consists of a knuckle, a pin, an upper leaf and a lower leaf. The upper leaf features drilled holes or other attachment means that allow the upper leaf to connect to the upper attachment bar, or alternately to the upper back plate itself. The lower leaf attaches to the lower or second attachment bar or the lower back plate. Each of the upper and lower leaves features a bore positioned such that when the upper and lower leaves are fully extended and the devices is in an "unfolded" or "open" state, the bores align such that a pin or other object can be inserted into each bore, locking the leaves in place with respect to each other and the rest of the device. In preferred embodiments and the anticipated best mode of the device, the lower leaf features a shelf or indention that is complementary to at least a portion of the upper leaf. When the device is unfolded (the upper half and lower portion are moved dorsally or away from each other) for use, the upper leaf contacts this shelf on the lower leaf preventing the upper leaf, and the upper portion of the device, from moving any further (dorsally). In addition, when in this position, the bores on the upper leaf and lower leaf align allowing for the insertion of a pin into the bores, thereby locking the two leaves in place and locking the device in an "open" or "unfolded" position. In preferred embodiments of the invention, the pin has a ring attached to it making it easy to pull out of the bores when the device is to be folded.

Further, preferred embodiments of the inventions include one or more attachment bars. The attachment bars are simply rigid bars that feature the drilled holes discussed above that allow for attachment means to be inserted.

In some embodiments, on the inside surface of the back support, is a form fitting cushion pad for comfort that is releasably secured using conventional attachment means, for easy removal, use in different locations along the back support, and for easy cleaning. Such attachment means include and are not limited to Hook and Loop fasteners, snaps, buttons, zippers, etc.

In use, the wearer puts the device on their back and secures the hip belt around their waist. Then the lead apron or other garment is attached to the device such that the garment is worn over the device. The shoulder extensions can fit into sleeves featured by the garment—the typical lead apron used by medical professionals often has sleeves already integrated into it. In addition, the protrusions or pins on the shoulder supports can be positioned to fit into or through holes featuring grommets in the garment to help hold the garment in place. When the hip belt is secured around the waist, and the garment is attached or draped over the device, the weight of the garment does not rest on the wearer's shoulders or spine, but is transferred to their hips. The lower and upper back plates are shaped such that the device, when the wearer stands upright, does not contact the user's back, neck or shoulders. A space between the user and the heavy garment is created by the device that allows air entering (through the sides or top of the apron or garment) to circulate and keep the wearer cooler than they would be if they wore the garment against their person. The device thereby allows the wearer to perform lengthy medical procedures, even those that require bending over the patient for prolonged periods of time, without having to support the weight of the required radio-opaque garments with their shoulders or backs.

The inventive weight support allows the user to use/wear heavy shielding garments without obstructing the function of those garments. The invention allows a user to wear various types of heavy clothing or equipment without interfering with the normal movements of the wearer. The device also provides lumbar support and improves body ventilation for those wearing heavy shielding garments. By transferring weight away from the shoulders, the device reduces the incidence of cervical orthopedic injury sustained by the user. By providing lumbar support to the user, the weight support also results in improved posture and reduces the incidence of lower back strain and injury. Moreover, because the weight support creates some separation between the clothing and the user, the weight support serves to provide additional ventilation that is not available when the user wears the same clothing or equipment directly against their body. The device is light weight, comfortable, durable, easy to clean, and easy to put on or remove. In addition, since the device is not integrated into a garment, the device can be used with more than one garment including a "half-garment" that is meant to be worn only over front of the wearer. In such embodiments, the back support and other components of the device can be made of or infused with radio-opaque materials to help increase the shielding provided by the garment.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale. Generally, references to upward directions, including "above" and "over" indicate a direction towards the wearer's head when the device is being worn. Directions indicating a downward direction including "beneath" and "under" indicate a direction toward the wearer's feet when the device is being worn. "Ventral" refers to a direction towards the wearer's abdomen while the device is being worn. "Dorsal" refers to a direction towards the back support of the device.

BRIEF DESCRIPTION OF THE SEVERAL VIEWS OF THE DRAWING(S)

DETAILED DESCRIPTION OF THE INVENTION

Figure 1:
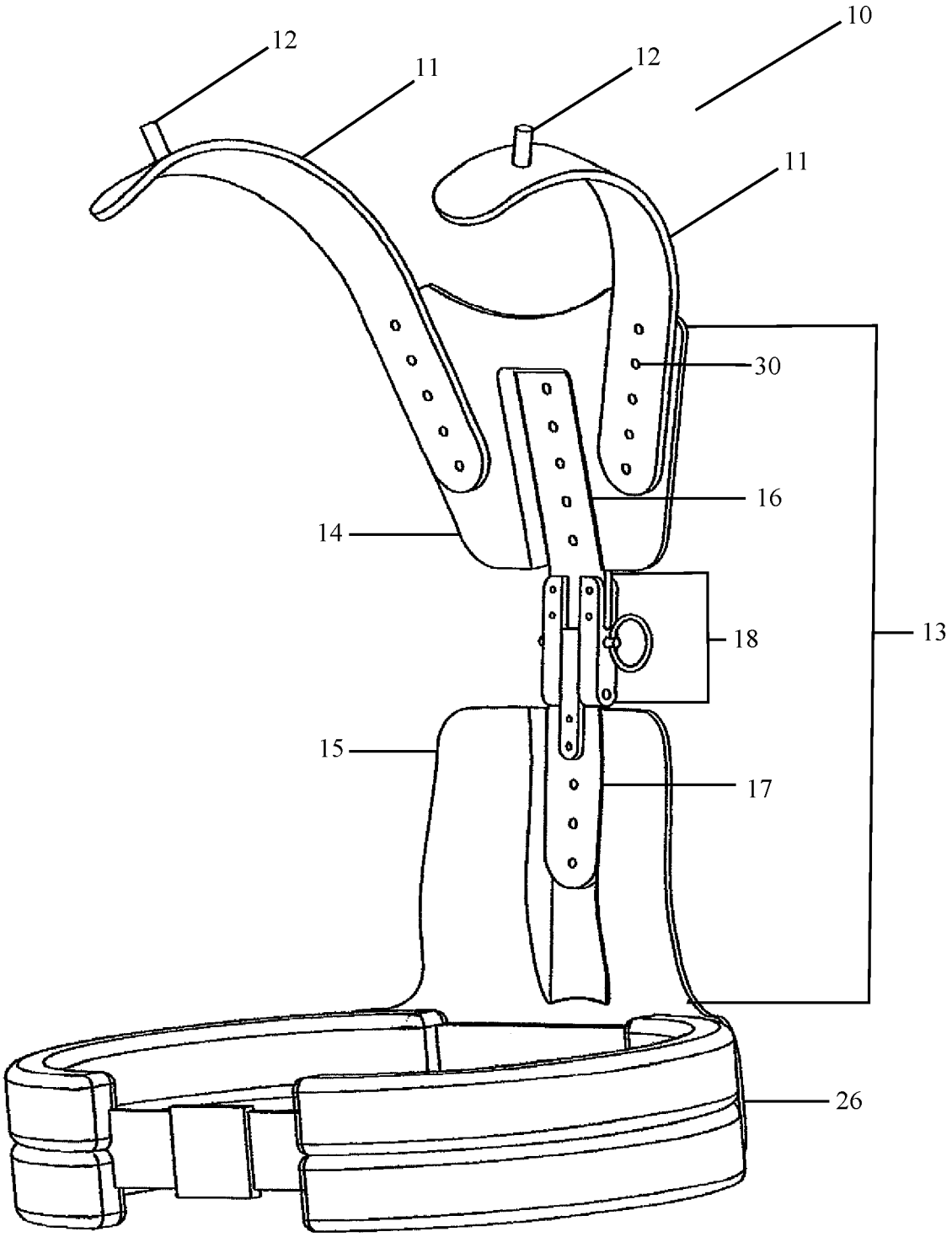
FIG. 1 is a front perspective view of a preferred embodiment of the present invention in an "unfolded" or "open" configuration.

Referring now to the invention in more detail, FIG. 1 shows a perspective view of the device, generally 10, in an "unfolded" or "open" state. The device or frame includes two shoulder extensions 11 that are elongated, rigid bars that are shaped such that, when attached to the device 10, they are positioned to extend up and over a wearer's shoulders. In preferred embodiments and the anticipated best mode of the device 10, the shoulder extensions 11 feature pins 12 protruding from an upper surface of the shoulder extensions 11, away for the wearer. As previously discussed, these pins can be used to support other equipment, including a face shield. In addition, the shoulder extensions 11 are attached to a back support, generally 13. The back support 13 is generally made of one or more back plates. In the embodiment shown in the drawings, the back support consists of an upper back plate 14, a lower back plate 15, an upper attachment bar 16, a lower attachment bar 17 and a hinge 18. The upper back plate 14 and shoulder extensions 11 feature drilled holes 30 in their surfaces. The drilled holes 30 are the same size and contain the same threading, if any. These holes 30 are used to attach the shoulder extensions 11 to the upper back plate 14. Note, there are a series of holes 30 in both parts of the device. As a result, the wearer can change the height of the shoulder extensions 11. If desired, the upper back plate 14 can have a second set of drilled holes 30 and as such, the shoulder extensions 11 positions could be adjusted in other directions—namely laterally with respect to their original position on the upper back plate 14.

FIG. 1 also shows the upper attachment bar 16 and the lower attachment bar 17. These bars are rigid bars, preferably made of Aluminum or another metal, that serve to separate the various back support 13 components from each other, i.e. to space them out enough that the device 10 can be attached to the wearer's waist area while the shoulder extensions 11. The attachment bars feature drilled holes 30 similar to or the same as the drilled holes 30 in the upper back plate 14 and the shoulder extensions 11. These drilled holes 30 are used to attach the upper back plate 14 the upper attachment bar 16. The upper attachment bar 16 also features drilled holes 30 or other conventional attachment means that attach the upper attachment bar 16 to the hinge 18 located beneath it.

Similarly, the lower attachment bar 17 is structurally similar or the same as the upper attachment bar 16. It is a rigid bar featuring drilled holes 30 that are complementary to drilled holes 30 on the hinge 18 and the lower back plate 15. Similarly, the hip belt 26 is attached to the lower back plate 15.

Figure 2:
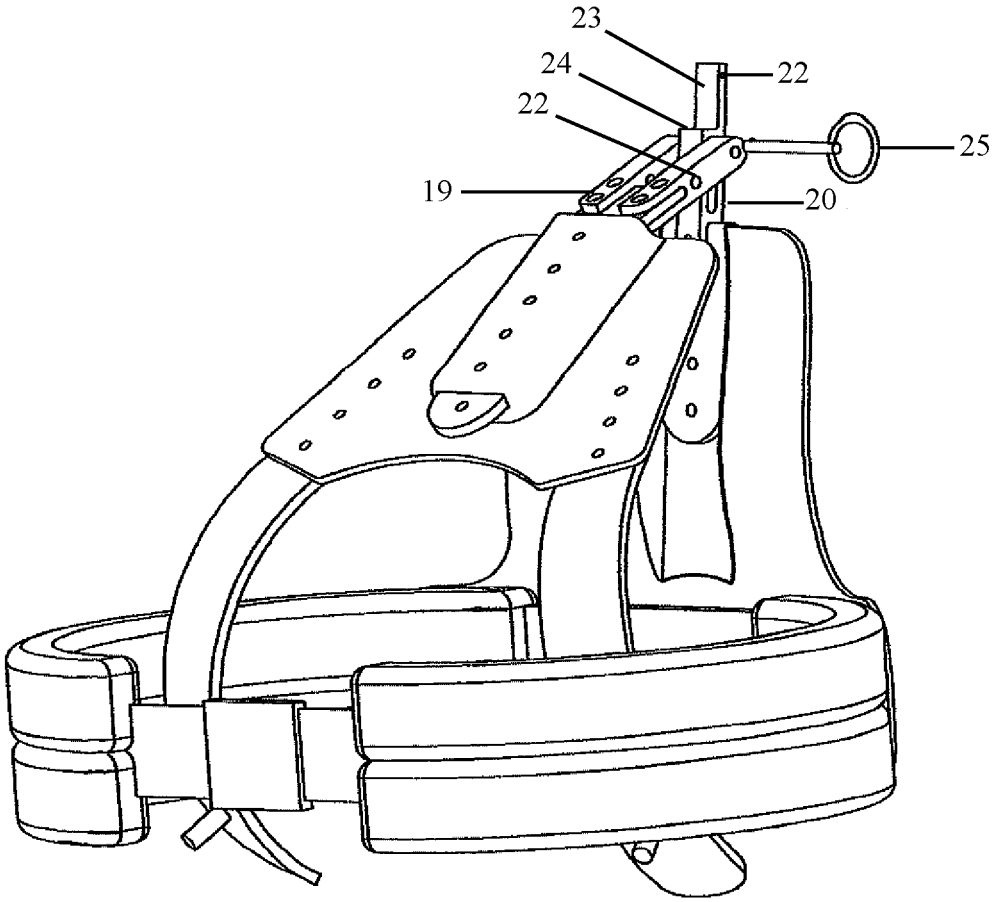
FIG. 2 is a front perspective view of a preferred embodiment of the present invention in a "folded" or "closed" configuration.

The hinge 18 is best illustrated in FIG. 2. FIG. 2 is a perspective view of the device 10 in a "folded" or "closed" configuration. The hinge 18 consists of two leaves—an upper leaf 19 and a lower leaf 20—as well as at least one bore 22 in each leaf and a pin 25. FIG. 2 shows the lower leaf 20 in detail. The lower leaf 20 attaches to the lower attachment bar 17 as discussed above. In addition, the lower leaf 20 has a ventral surface 23, i.e. a surface that would face towards the wearer's body when the device 10 is worn. The ventral surface 23 features a shelf 24 or indention that faces ventrally. In addition, the lower leaf 20 features a bore 22 that passes completely through the lower leaf 20. Similarly, the upper leaf 19 is attached to the upper attachment bar 16 and features a complementary bore 22 through it. As can be seen from FIGS. 1 and 2, the pin 25 can be inserted through the bores 22 in the upper leaf 19 and lower leaf 20 and in doing so, the pin 25 prevents the two leaves 19, 20 from moving with respect to one another or the rest of the device 10. As a result, the pin locks the device into an upright, "open" or "unfolded" position. Similarly, when the pin is removed from the bores 22, the leaves 19, 20 are allowed to move relative to each other and the device 10 and the upper portion of the device 10, consisting of the shoulder extensions 11, upper back plate 14 and upper attachment bar 16 can be folded down to the point where it contacts the lower portion of the device 10, consisting of the lower attachment bar 17 the lower back plate 15 and the hip belt 26.

Figure 3:
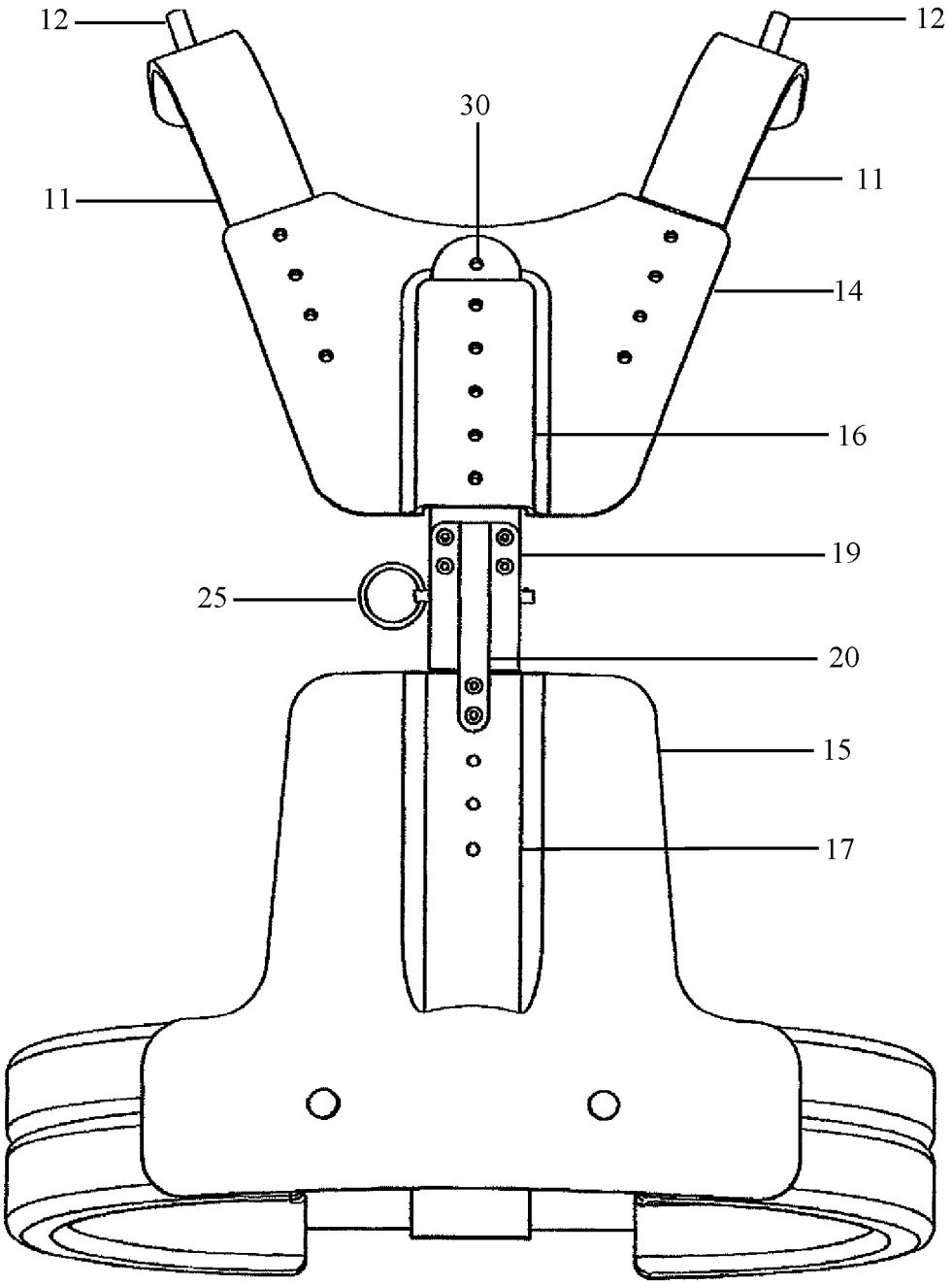
FIG. 3 is a rear perspective view of a preferred embodiment of the present invention in an "unfolded" or "open" configuration.
Figure 4:
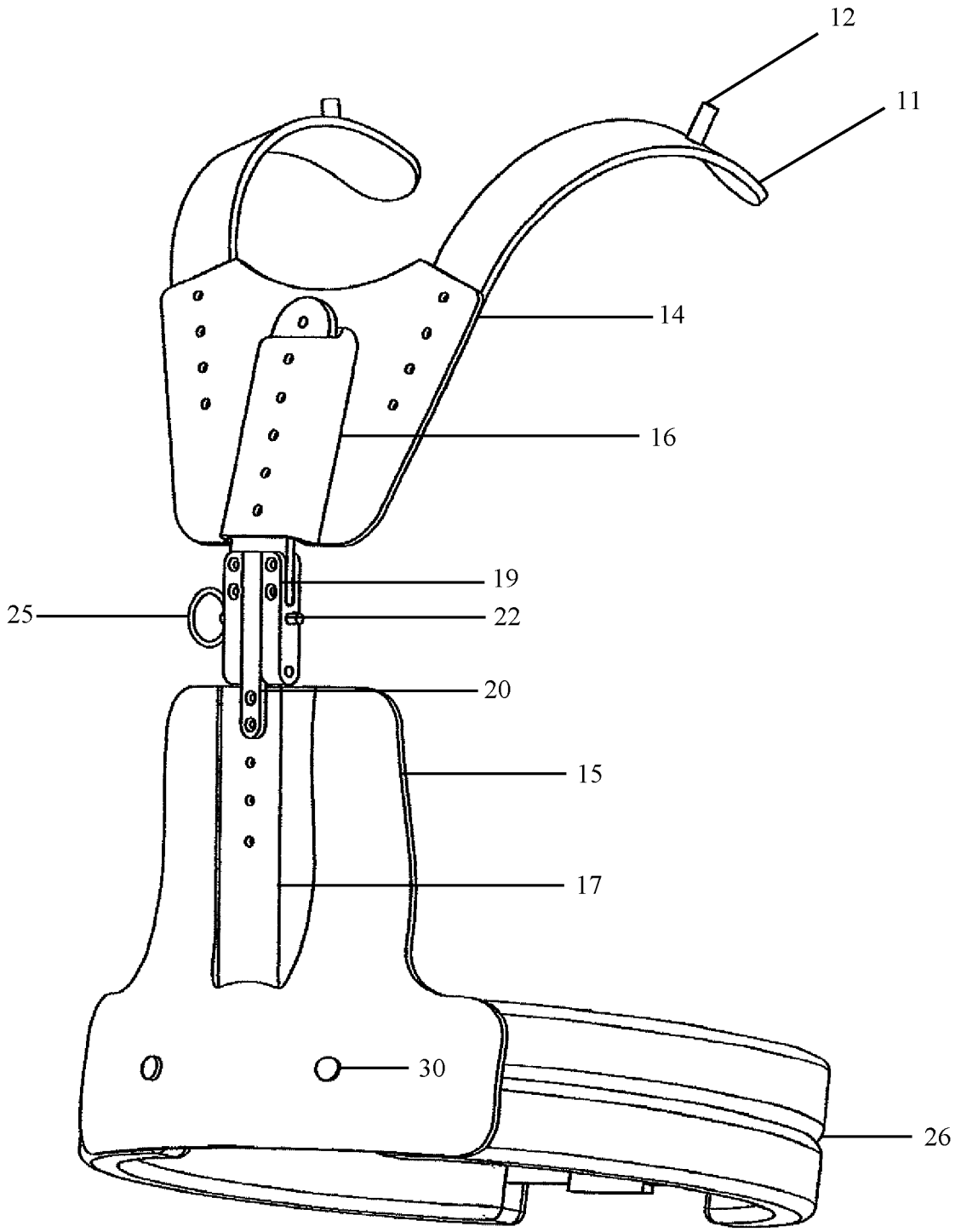
FIG. 4 is a rear perspective view of a preferred embodiment of the present invention in an "unfolded" or "open" configuration.

FIGS. 3 and 4 show the device 10 from the rear or back of the device, i.e., the portion of the device that would face away from the wearer when the device 10 is in use. FIGS. 3 and 4 show the device 10 in an "unfolded" state—ready for use. These figures show the shoulder extensions 11 featuring pins 12 and drilled holes 30 attached to the upper back plate 14. In addition, FIGS. 3 and 4 show the upper attachment bar 16 attached to and linking the upper back plate 14 to the upper leaf 19 of the hinge 18. FIGS. 3 and 4 show the upper leaf 19 and lower leaf 20 engaged or in contact with each other and locked in place with the pin 25 inserted through the bores 22. The lower attachment bar 17 is attached via drilled holes 30 to the lower back plate 15 at one end and the lower leaf 20 of the hinge 18 at the other end.

Figure 5:
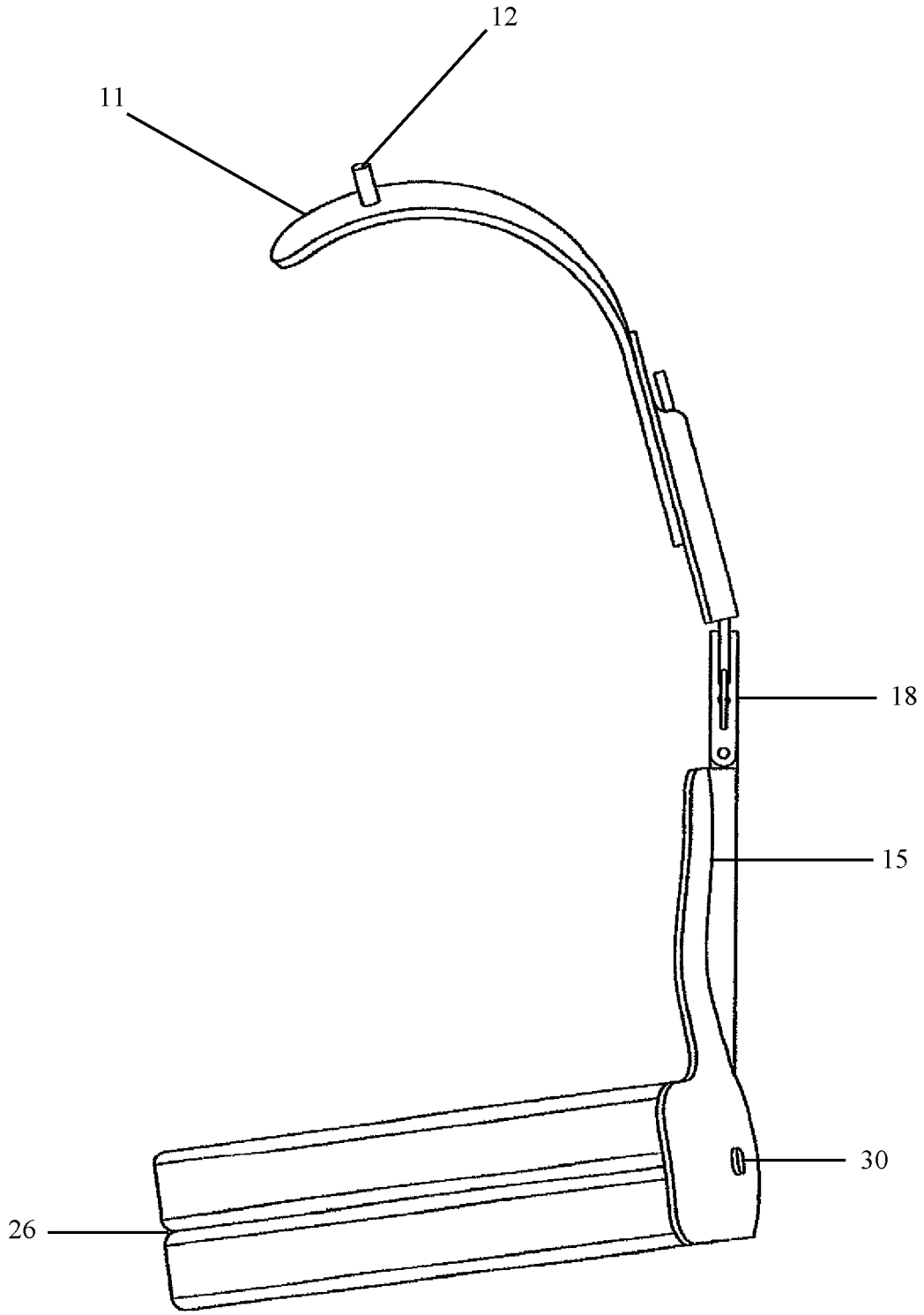
FIG. 5 is a front perspective view of a preferred embodiment of the present invention in an "unfolded" or "open" configuration.
Figure 6:
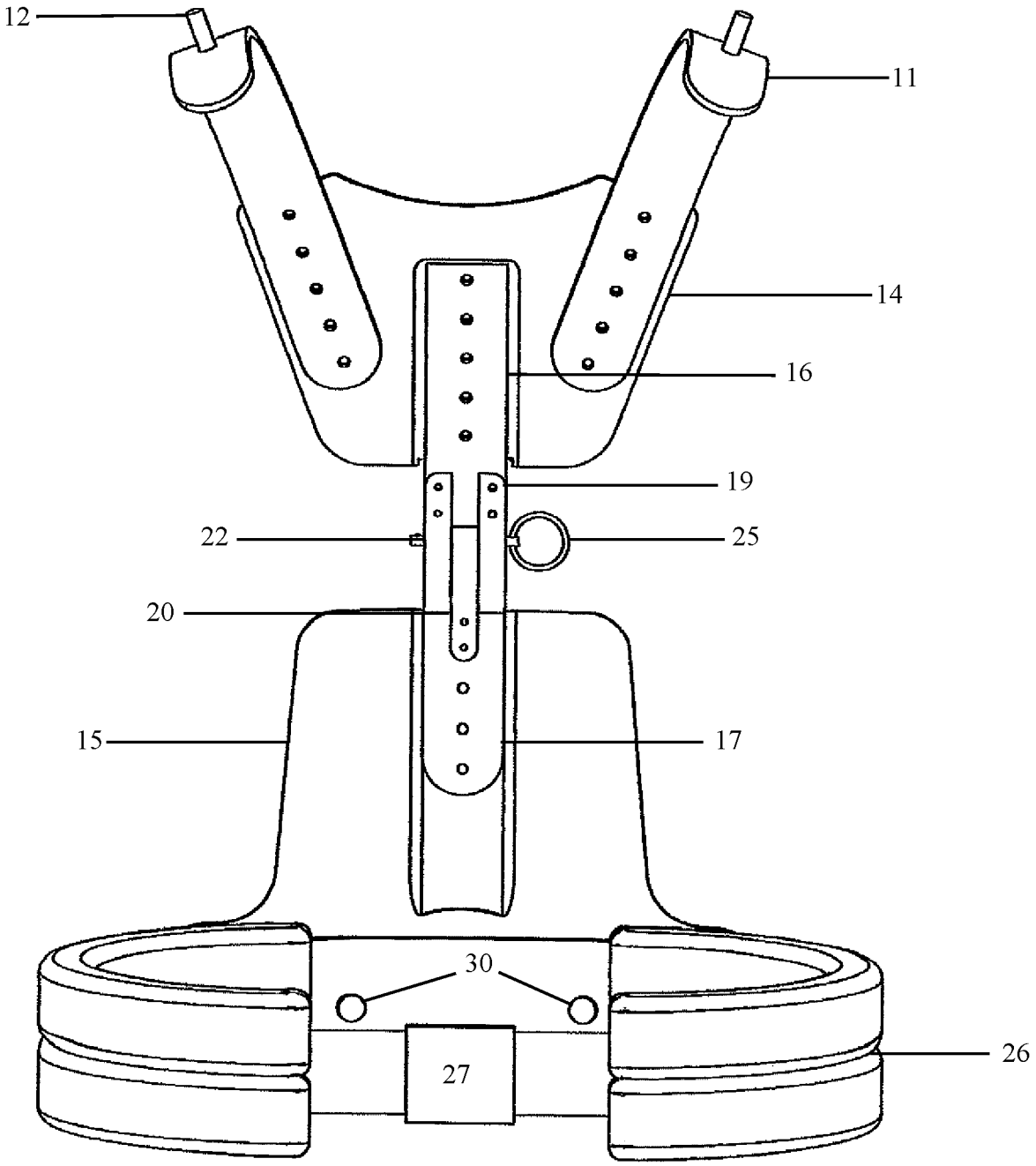
FIG. 6 is a side perspective view of a preferred embodiment of the present invention in an "unfolded" or "open" configuration.

FIGS. 3, 4 and 5 show the hip belt 26 in more detail. These figures show the means of attaching the hip belt 26 to the lower back plate 15—drilled holes 30 in the lower back plate 15 that align with holes 30 in the hip belt 26. The hip belt 26 is a padded belt that is meant to be worn around the wearer's waist are and has a buckle or clasp 27 allowing the wearer to attach the two free ends of the hip belt 26.

Referring now to FIGS. 1 through 6, the device is used in the following manner. The person desiring to use the device places the device 10 onto their back while leaning forward. The wearer then adjusts the position of the device such that the shoulder extensions are in place above the wearer's shoulders. Generally, the inventors anticipate that most wearer's will position the device 10 such that it is 0.75 to 1 inch above each of their shoulders. As discussed, the height of the shoulder extensions can be adjusted to position the shoulder extensions 11 to the liking of the wearer. Once the device 10 is positioned roughly where the wearer wants it, the wearer wraps the hip belt 26 around their body, usually around the wearer's waist, engages the buckle and tightens the belt around their body. The location of the hip belt 26 in relation to the rest of the device 10 can be adjusted by additional drilled holes in the lower back plate 15 that allow for the wearer to attach the hip belt 26 at different points along the lower back plate 15.

The shape and design of the device 10 are such that the back support is angled away from the body of the wearer so that it does not come into contact with the back or body of the wearer while the wearer is standing straight. The device also functions well when the wearer is bending forward. The effect of taking the weight off of the wearer's shoulders and transferring it to the hips is that the weight of the garment (and device) is not born by the user's shoulders or lower back. In addition, because the garment worn over the device necessarily has holes through which the user's arms and head can protrude, there is opportunity for air to flow into the garment and cool the wearer. As discussed above, there is ample room for air to flow around the wearer's entire torso, including their back as the device is only snug against the wearer's body at the hips.

Preferred embodiment and the anticipated best mode of the invention are constructed as follows. The shoulder extensions are produced from 1.5 inch wide 6061 aluminum bars that are flattened such that they are 3/16 of an inch thick. The aluminum pins or protrusions are constructed from 6061 aluminum round stock and cut to a length of 3/8 inches and a diameter of 5/16 inches. The pins are attached to the shoulder extensions using any conventional attachment means and can be integrally formed with the shoulder extensions. In preferred embodiments, the pins are attached using one or more stainless steel flathead #6-32 machine screws and are secured using one ore more #6-32 stainless steel lock nuts. The upper and lower back plates are ideally custom vacuum formed kydex plates that are shaped to be comfortable, ergonomic and to create space between the wearer and the garment supported by the device. The accessory bars are aluminum bars and are attached to the slip hinge with 10-24 stainless steel machine screws and nylon lock nuts. The machined aluminum slip hinge is made of 6061 aluminum as well. Stainless steel binding barrels have a 1/4 inch-20 thread and are 3/8 inches long. Moreover, the parts of the device can be made or infused with radio-opaque material to improve the level of protection afforded to the wearer, especially when they are wearing a garment that is only mean to cover the front of the wearer. A binding barrel or binding nut is a nut with an internally threaded hole and an extended smooth body with a head or flanged end. There are two main types available. Those also known as dowel nuts have an internally threaded hole that is perpendicular to the nut's length and are often used with bolts in furniture assembly to create joints. They may have a slotted head for adjusting. Those also known as binding nuts have a head or flange on one end and internal threading that can accept a binding post or screw to bolt thin materials, such as sheet metal, to other parts. The head may include a drive style, such as Phillips or slotted.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A fixed-angle device configured to transfer weight to the pelvis of a wearer comprising:

shoulder extensions that comprise rigid bars extending above the wearer's shoulders, a hip belt and a back support connected at one end to the shoulder extensions and at an opposing end to the hip belt;

wherein the back support includes a hinge that allows the back support to bend ventrally relative to its longitudinal axis and wherein the hinge comprises an upper leaf, a lower leaf, and a pin; and wherein each leaf features a bore and said bores are positioned to align when the upper leaf and a ventral surface of the lower leaf are in contact with each other.

2. The fixed-angle device of claim 1 wherein binding barrels are used to attach the back support to the shoulder extensions and the hip belt.

3. The fixed-angle device of claim 2 wherein the back support contains radio-opaque materials.

4. A fixed-angle device configured to transfer weight to the pelvis of a wearer comprising:

shoulder extensions that comprise rigid bars extending above the wearer's shoulders, a hip belt and a back support connected at one end to the shoulder extensions and at an opposing end to the hip belt;

wherein the back support comprises:

an upper back plate featuring drilled holes;

a lower back plate featuring drilled holes;

an attachment bar comprising a rigid bar featuring a plurality of drilled holes at each of two opposing ends; and wherein the upper back plate is attached to one end of the attachment bar using attachment means inserted into the drilled holes on the back plate and one end of the attachment bar and the opposing end of the attachment bar is attached to the lower back plate using attachment means inserted into the drilled holes on the lower back plate and the opposing end of the attachment bar.

5. A fixed-angle device configured to transfer weight to the pelvis of a wearer comprising:

shoulder extensions that comprise rigid bars extending above the wearer's shoulders, a hip belt and a back support connected at one end to the shoulder extensions and at an opposing end to the hip belt;

wherein the back support comprises:

an upper back plate featuring drilled holes;

a lower back plate featuring drilled holes;

a first and a second attachment bar comprising rigid bars featuring a plurality of drilled holes at each of two opposing ends; and wherein the first attachment bar is attached to the upper back plate at one end and the hinge at the other end and the second attachment bar is attached to the lower back plate at one end and the hinge at the other end.

6. The fixed-angle device of claim 5 wherein the hinge comprises an upper leaf, a lower leaf, and a pin; and wherein each leaf features a bore and said bores are positioned to align when a ventral surface of the upper leaf and a ventral surface of the lower leaf are in contact with each other thereby preventing the leaves from rotating around the pin towards their dorsal surfaces.

7. The fixed-angle device of claim 6 further comprising a locking pin sized and shaped to be inserted into the bores when they are aligned thereby engaging the upper leaf and the lower leaf such that they cannot rotate in either direction.

8. The fixed-angle device of claim 7 wherein binding barrels are used to attach the upper and lower back plates to their respective attachment bars and to attach the hip belt to the lower back plate.

9. The fixed angle-device of claim 8 wherein the shoulder supports feature pins that extend away from a surface of the shoulder extensions.

10. The fixed-angle device of claim 8 wherein the back support contains radio-opaque materials.

11. The fixed-angle device of claim 5 wherein the hinge comprises an upper leaf, a lower leaf, a pin and a knuckle; wherein each leaf features a bore and said bores are positioned to align when a ventral surface of the upper leaf and a ventral surface of the lower leaf are in contact with each other thereby preventing the leaves from rotating around the pin towards their dorsal surfaces.

12. The fixed-angle device of claim 11 wherein the back support contains radio-opaque materials.

13. A fixed-angle device configured to transfer weight to the pelvis of its wearer comprising:

shoulder extensions that comprise rigid bars extending above the wearer's shoulders;

a hip belt;

a back support connected at one end to the shoulder extensions and at an opposing end to the hip belt;

a hinge that allows the back support to bend relative to its longitudinal axis; wherein said hinge comprises an upper leaf, a lower leaf, a pin and a knuckle; wherein each leaf features a bore and said bores are positioned to align when a ventral surface of the upper leaf and a ventral surface of the lower leaf are in contact with each other; and a locking pin sized and shaped to be inserted into the bores when they are aligned thereby engaging the upper leaf and the lower leaf such that they cannot rotate in either direction.

14. The fixed-angle device of claim 13 the back support comprises:

an upper back plate featuring drilled holes;

a lower back plate featuring drilled holes;

a first and a second attachment bar comprising rigid bars featuring a plurality of drilled holes at each of two opposing ends; and wherein the first attachment bar is attached to the upper back plate at one end and the hinge at the other end and the second attachment bar is attached to the lower back plate at one end and the hinge at the other end.

15. The fixed angle-device of claim 14 wherein the shoulder supports feature pins that extend away from a surface of the shoulder extensions.

16. The fixed-angle device of claim 15 wherein the back support contains radio-opaque materials.

17. The fixed-angle device of claim 13 wherein the back support contains radio-opaque materials.

* * * * *